US009080476B2

(12) United States Patent
Fujikawa

(10) Patent No.: US 9,080,476 B2
(45) Date of Patent: Jul. 14, 2015

(54) LUBRICATING DEVICE FOR ENGINE PROVIDED WITH TURBOCHARGER

(75) Inventor: Hiroyuki Fujikawa, Hamamatsu (JP)

(73) Assignee: SUZUKI MOTOR CORPORATION, Hamamatsu-Shi, Shizuoka-Ken (JP)

( * ) Notice: Subject to any disclaimer, the term of this patent is extended or adjusted under 35 U.S.C. 154(b) by 530 days.

(21) Appl. No.: 12/980,894

(22) Filed: Dec. 29, 2010

(65) Prior Publication Data

US 2011/0168126 A1 Jul. 14, 2011

(30) Foreign Application Priority Data

Jan. 8, 2010 (JP) ..... 2010-003043

(51) Int. Cl.
*F01M 1/02* (2006.01)
*F01M 11/02* (2006.01)
*F02B 39/14* (2006.01)

(52) U.S. Cl.
CPC ..... *F01M 11/02* (2013.01); *F02B 39/14* (2013.01)

(58) Field of Classification Search
USPC ..... 123/196 A, 196 R, 196 CP; 184/6.11, 184/6.16, 6.18, 6.28, 14, 15.1; 60/605.3; 417/407, 477.14, 423.13
See application file for complete search history.

(56) References Cited

U.S. PATENT DOCUMENTS

| | | | | |
|---|---|---|---|---|
| 6,205,987 | B1 * | 3/2001 | Shigedomi et al. | 123/583 |
| 6,260,533 | B1 * | 7/2001 | Tanaka | 123/196 R |
| 6,308,679 | B1 * | 10/2001 | Nakamura et al. | 123/195 R |
| 2007/0102215 | A1 * | 5/2007 | Pichler et al. | 180/190 |
| 2010/0139606 | A1 * | 6/2010 | Yorita et al. | 123/192.2 |

FOREIGN PATENT DOCUMENTS

| | | |
|---|---|---|
| JP | 5-66229 | 3/1993 |
| JP | 2005-264917 | 9/2005 |

* cited by examiner

*Primary Examiner* — Erick Solis
*Assistant Examiner* — Ruben Picon-Feliciano
(74) *Attorney, Agent, or Firm* — Barnes & Thornburg LLP

(57) ABSTRACT

An engine provided with a turbocharger includes a timing chain, a chain case mounted to one end in an axial direction of a crankshaft disposed in the so as to cover the timing chain to define a chain chamber, a turbocharger disposed on one side in a width direction of the engine and driven by an exhaust gas and including a bearing portion, and a lubricating device for lubricating oil within the engine. The lubricating device includes an oil pan disposed below the engine, and an oil drain passage through which the oil lubricating the bearing portion returns to the oil pan. The oil drain passage has an oil drain port which is opened to the chain chamber defined by the one end portion of the axial direction of the crankshaft in the engine and the chain case.

4 Claims, 6 Drawing Sheets

LUBRICATING DEVICE FOR ENGINE PROVIDED WITH TURBOCHARGER

BACKGROUND OF THE INVENTION

1. Field of the Invention

The present invention relates to a lubricating device for an engine provided with a turbocharger particularly capable of preventing mixing of air bubbles into oil that lubricates a bearing portion of the turbocharger and returns to an oil pan.

2. Description of the Related Art

In an engine provided with a turbocharger, a lubricating device supplies oil to a bearing portion of the turbocharger driven by an exhaust gas and oil lubricates in a bearing portion. In the lubricating device for an engine provided with a turbocharger, an oil is supplied by a supply pipe to the bearing portion to lubricate the bearing portion and then returns to the engine through an oil drain pipe.

In a conventional lubricating device for an engine provided with a turbocharger, as described in Japanese Patent Laid-Open Publication No. 2005-264917 (Patent Document 1) and Japanese Utility Model Laid-Open Publication No. 5-66229 (Patent Document 2), a bearing portion and a crankcase arranged to a lower portion of a cylinder block are connected by means of oil drain pipe to provide communication between an oil drain passage in the oil drain pipe and a crank chamber in the crankcase. The lubricating device passes oil discharged from the bearing portion of the turbocharger through an oil discharge port of the oil drain passage into the crank chamber and returns the oil to an oil pan disposed to a lower portion of the engine.

However, in the conventional lubricating device for an engine provided with a turbocharger, when the oil is returned into the oil pan and the crankcase, the oil may come into contact with a web of a crankshaft rotated in the crank chamber in the crankcase, which may result in spattering of oil. Thus, in the conventional lubricating device, there is a case such that air bubbles may be mixed into the oil that has dropped into the oil pan.

SUMMARY OF THE INVENTION

The present invention was conceived in consideration of the circumstances described above in the prior art and an object thereof is to provide a lubricating device for an engine provided with a turbocharger capable of preventing mixing of air bubbles into oil that lubricates a bearing portion of the turbocharger and then returns to an oil pan.

The above and other objects can be achieved according to the present invention by providing, in one aspect, a lubricating device for an engine provided with a turbocharger, the engine being provided with a timing chain, a chain case mounted to one end in an axial direction of a crankshaft disposed in the so as to cover the timing chain to define a chain chamber, a turbocharger disposed on one side in a width direction of the engine and driven by an exhaust gas and including a bearing portion, and a lubricating device for lubricating oil within the engine, the lubricating device comprising:

- an oil pan disposed below the engine; and
- an oil drain passage through which the oil lubricating the bearing portion returns to the oil pan,
- the oil drain passage having an oil drain port which is opened to the chain chamber defined by the one end portion of the axial direction of the crankshaft in the engine and the chain case.

A preferred embodiment may include the following examples.

The oil discharge port may be formed to be opened to a portion between a chain guide disposed on a tension side of the timing chain and a joint surface to the chain case of the engine.

The lubricating device may further include an oil pump disposed in the chain chamber and driven by the crankshaft, wherein an oil dropping space is formed below the oil discharge port so as to communicate with the oil pan, and the oil pump has an expanded portion incorporated with a pressure regulating valve, the expanded portion being provided at a portion below the chain guide and between the oil dropping space and the timing chain extending downward from the chain guide.

It may be desired that a protruding portion is formed to at least one of the expanded portion and one end wall at one end in the axial direction of the crankshaft of the engine so as to protrude toward another one thereof to thereby block a gap between the expanded portion and the one end wall of the engine facing the expanded portion.

According to the lubricating device for an engine provided with a turbocharger of the aspect mentioned above, the oil discharge port of the oil drain passage is opened to the chain chamber provided between the one end of the engine and the chain case, and thus, the oil discharged from the turbocharger can bypass a crank chamber and return to the oil pan. Therefore, the oil that has lubricated the turbocharger and been discharged from the oil discharge port can be prevented from coming into contact with a web of the crankshaft rotated in the crank chamber and scattering, and moreover, air bubbles can be also prevented from being mixed into dropping oil.

The nature and further characteristic features of the present invention will be made clearer from the following description made with reference to the accompanying drawings.

DESCRIPTION OF THE PREFERRED EMBODIMENT

An embodiment of the present invention will be described hereunder with reference to the accompanying drawings, and it is to be noted that, in these figures, terms of "upper", "lower", "right", "left" and the like terms showing direction are based on arrowed directions or illustrated state in the respective drawings.

Figure 1:
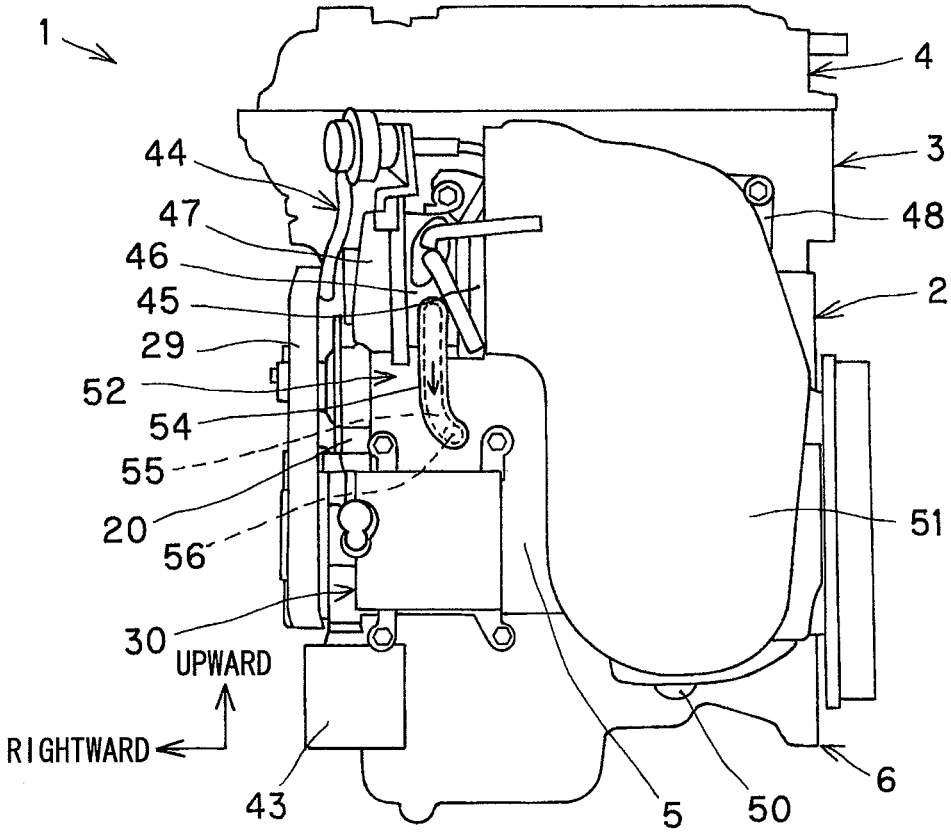
FIG. 1 is a front view of an engine provided with a turbocharger including a lubricating device according to one embodiment of the present invention.
Figure 2:
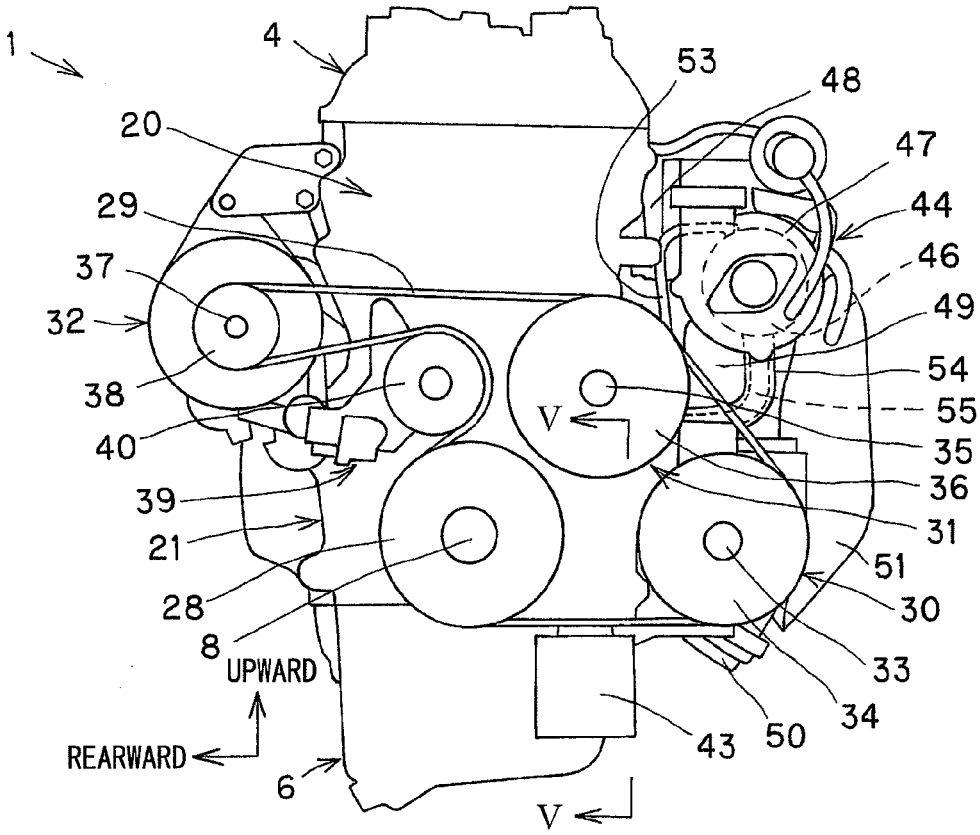
FIG. 2 is a side view of the engine provided with a turbocharger including the lubricating device shown in FIG. 1.
Figure 3:
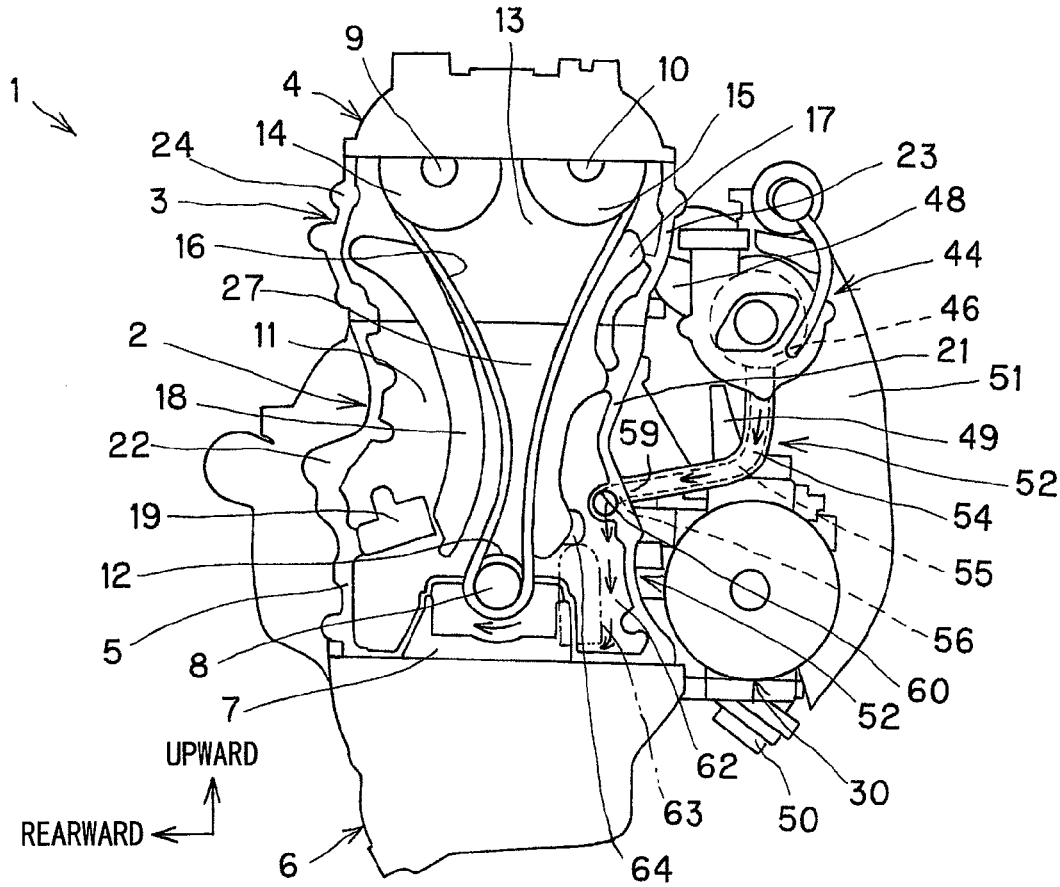
FIG. 3 is also a side view of the engine with a turbocharger including the lubricating device provided with a chain cover being removed.
Figure 4:
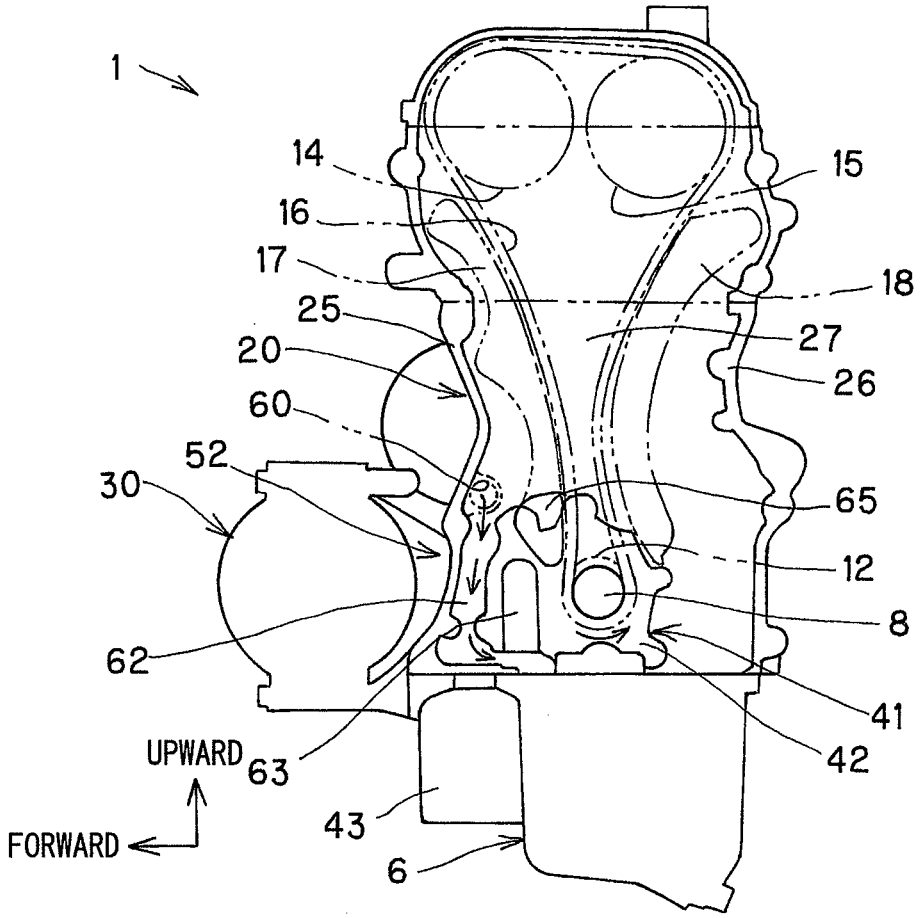
FIG. 4 is a side view showing an interior of the chain cover as viewed in a side view of the engine provided with a turbocharger according to the embodiment.

FIGS. 1 to 5 show one preferred embodiment of the present invention, and in FIGS. 3 and 4, reference numeral 1 denotes an engine provided with a turbocharger. The engine provided with a turbocharger (hereinafter referred to as "engine") 1 includes a cylinder block 2, a cylinder head 3 mounted to an upper portion of the cylinder block 2, a cylinder head cover 4 mounted to an upper portion of the cylinder head 3, a crankcase 5 disposed in a lower portion of the cylinder block 2, and an oil pan 6 mounted to the crankcase 5.

In the engine 1, a crank chamber 7 is formed in the crankcase 5 of the cylinder block 2, and a crankshaft 8 is supported therein, and an intake cam shaft 9 and an exhaust cam shaft 10 are journaled on the cylinder head 3 in the engine 1.

Furthermore, in the engine 1, a crank sprocket 12 is mounted to the crankshaft 8 in a manner protruding from one end wall 11 at one end in an axial direction of the crankshaft of the cylinder block 2, an intake cam sprocket 14 and an exhaust cam sprocket 15 are mounted to the intake cam shaft 9. The exhaust cam shaft 10 protruding from one end wall 13 at one end in the axial direction of the crankshaft of the cylinder head 3, and a timing chain 16 is wound around the crank sprocket 12, the intake cam sprocket 14 and the exhaust cam sprocket 15.

The timing chain 16 extends from the intake cam sprocket 14 toward the exhaust cam sprocket 15 by the crank sprocket 12 rotating clockwise in FIG. 3 and transmits the rotational motion of the crankshaft 8 to the intake cam shaft 9 and the exhaust cam shaft 10. On the one end wall 11 of the cylinder block 2 and the one end wall 13 of the cylinder head, a chain guide 17 is mounted on a tension side (right side in FIG. 3) of the timing chain 16, and a chain tensioner 18 and a tension adjustor 19 are provided on a loose side (left side in FIG. 3) of the timing chain 16.

In the engine 1, a chain case 20 covering the timing chain 16 is mounted to one end in the crankshaft direction. On the one end wall 11 of the cylinder block 2, as shown in FIG. 3, an exhaust side joint surface 21 and an intake side joint surface 22 are provided at opposite side edges in a width direction perpendicular to the crankshaft direction of the engine 1.

On the one end wall 13 of the cylinder head 3, an exhaust side joint surface 23 and an intake side joint surface 24 are provided at opposite side edges in the width direction of the engine 1.

In the chain case 20, as shown in FIG. 4, an exhaust side joint surface 25 and an intake side joint surface 26 are provided at opposite side edges in the width direction. The chain case 20 is mounted so that the joint surfaces 25 and 26 abut against the joint surfaces 21 and 22, respectively, of the cylinder block 2, and the joint surfaces 23 and 24, respectively, of the cylinder head 3.

A chain chamber 27 is defined in the engine 1 at one end in the axial direction of the crankshaft so as to be surrounded by the one end wall 11 of the cylinder block 2, the one end wall 13 of the cylinder head 3, and the chain case 20.

In the engine 1, as shown in FIGS. 1 and 2, the crankshaft 8 is protruded from the chain case 20 at one end in the axial direction of the crankshaft, and a crank pulley 28 is mounted to the crankshaft 8. At the axial one end of the crankshaft 8, the engine 1 is mounted with an air conditioning compressor 30, a water pump 31 and a generator 32 as auxiliary equipments or components driven in accordance with the operation of the crank pulley 28 through an auxiliary belt 29.

The air conditioning compressor 30 is arranged at the lower portion of the cylinder block 2 on one side in the width direction perpendicular to the axial direction of the crankshaft 8 of the engine 1, and a compressor pulley 34 is mounted to a compressor shaft 33. The water pump 31 is arranged in the chain case 20 on one side in the width direction of the engine 1, and a water pump pulley 36 is mounted to a water pump shaft 35. The generator 32 is arranged on the other side in the width direction of the cylinder block 2 in the engine 1, and a generator pulley 38 is mounted to a generator shaft 37.

The auxiliary belt 29 is wound around the crank pulley 28, the compressor pulley 34, the water pump pulley 36, and the generator pulley 38. The tensioner pulley 40 of the belt tensioner 39 applies tension to the auxiliary belt 29, and the auxiliary belt 29 transmits the rotation of the crankshaft 8 to the compressor shaft 33, the water pump shaft 35, and the generator shaft 37 to thereby drive the air conditioning compressor 30, the water pump 31, and the generator 32.

Figure 5:
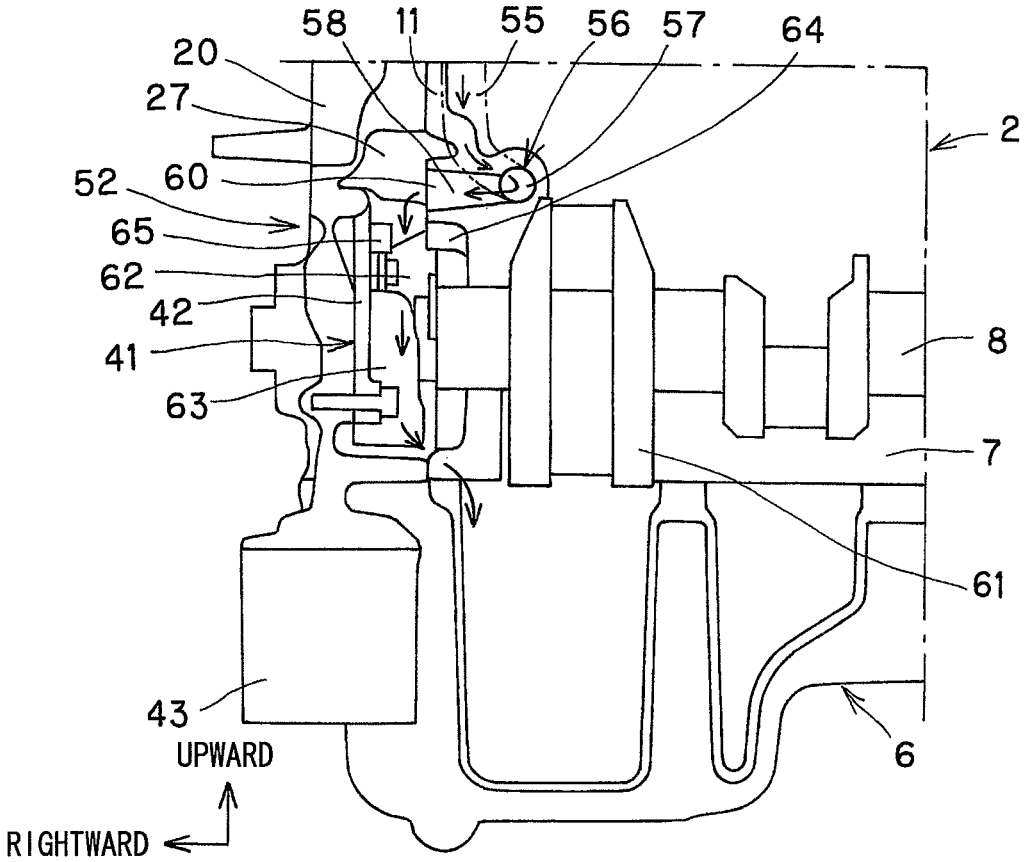
FIG. 5 is a sectional view, in an enlarged scale, taken along the line V-V in FIG. 2 according to the embodiment.

Furthermore, in the engine 1, as shown in FIGS. 4 and 5, an oil pump 41 driven by the crankshaft 8 is disposed in the chain chamber 27. The oil pump 41 includes a pump case 42 in the chain chamber 27 with an area where the crankshaft 8 is protruded, and is directly driven by the crankshaft 8. The oil pump 41 sucks oil in the oil pan 6 and discharges the oil. The discharged oil is filtered by an oil filter 43 and then supplied to the respective components or elements arranged in the engine 1 for lubrication.

In the engine 1, as shown in FIGS. 1 and 2, a turbocharger 44 that is driven by an exhaust gas is arranged on one side (right side in FIG. 2) in the width direction of the cylinder block. The turbocharger 44 includes a turbine 45, a bearing portion 46 and a compressor 47. The turbine 45 has an inlet connected to an exhaust manifold 48 mounted to one side in the width direction of the cylinder head 3 and an outlet connected to a catalyst converter 49, to which a downstream exhaust pipe 50 is connected. The exhaust manifold 48, the turbine 45 and the catalyst converter 49 are covered with an exhaust manifold cover 51. The compressor 47 is provided at a portion on the way of an intake pipe.

The engine 1 further includes a lubricating device 52 that lubricates the turbocharger 44.

In the lubricating device 52, as shown in FIG. 2, an oil supply pipe 53 supplies oil discharged by the oil pump 41 to the bearing portion 46, and an oil drain pipe 54, formed as an oil drain passage, returns the oil that has lubricated the bearing portion 46 to the engine 1. The oil drain pipe (passage) 54 has one end connected to a lower portion of the bearing portion 46, and the other end connected to the crankcase 5 in the lower portion of the cylinder block 2.

As shown in FIG. 3, the oil drain pipe 54 forms a pipe side oil drain passage 55, and on the other hand, a case side oil drain passage 56 with which the pipe side oil drain passage 55 communicates is formed in the crankcase 5.

As shown in FIG. 5, the case side oil drain passage 56 includes an introduction side passage section 57 and an exhaust side passage section 58. The introduction side passage section 57 is opened to an oil introduction port 59 (see FIG. 3) formed outside the crankcase 5 as a machined hole extending inside the crankcase 5. On the other hand, the exhaust side passage portion 58 extends from an end of the introduction side passage section 57 toward the one end portion in the axial direction of the crankshaft along the inside of the crankcase 5 and is formed as a cast hole opened to an oil discharge port 60 facing the chain chamber 27 formed outside the one end wall 11.

The lubricating device 52 discharges, to the chain chamber 27, the oil that has lubricated the bearing portion 46 through the pipe side oil drain passage 55 and the case side oil drain passage 56, and then returns the oil into the oil pan 6 disposed in the lower portion of the engine 1.

As shown in FIGS. 3 and 5, according to the lubricating device 52 of the engine 1 of the structure mentioned above, the oil discharge port 60 formed in the case side oil drain passage 56 is opened to the chain chamber 27 surrounded by the one end wall 11 at one end in the axial direction of the crankshaft of the engine 1 and the chain case 20, and thus, the oil discharged from the bearing portion 46 of the turbocharger 44 can bypass the crank chamber 7 and be returned to the oil pan 6.

Accordingly, the lubricating device 52 can prevent the oil, that has lubricated the bearing portion 46 of the turbocharger 44 and discharged from the oil discharge port 60, from coming into contact with a web 61 of the crankshaft 8 rotated in the crank chamber 7 and then from scattering, thereby preventing air bubbles from being mixed into the dropping oil.

As shown in FIGS. 3 and 4, in the lubricating device 52, the oil discharge port 60 is opened between the chain guide 17 located on the tension side of the timing chain 16 and the joint surface 21 to the chain case 20 of the cylinder block 2 constituting the engine 1.

According to the above structure, in the lubricating device 52, since the oil discharge port 60 is opened between the chain guide 17 and the joint surface 21, the oil discharged from the oil discharge port 60 into the chain chamber 27 by the chain guide 17 can be prevented from coming into contact with the timing chain 16 and scattering.

In the lubricating device 52, even if a part of the oil comes into contact with the timing chain 16, since the timing chain 16 on the tension side extends from an upper side to a lower side, the oil is delivered toward the oil pan 6 located in the lower portion of the engine, thus preventing the oil from scattering upward. Thus, the lubricating device 52 can prevent air bubbles from being generated in the oil that has dropped into the oil pan 6.

As shown in FIGS. 3 to 5, the lubricating device 52 is provided with an oil dropping space 62 communicating with the oil pan 6 in the chain chamber 27 at a portion below the oil discharge port 60, and the oil pump 41 driven by the crankshaft 8 is located in the chain chamber 27. The oil pump 41 is formed with an expanded portion 63 provided with a pressure regulating valve at a portion inside the chain case 20, and the expanded portion 63 is provided below the chain guide 17 and between the oil dropping space 62 and the timing chain 16 extending downward from the chain guide 17.

In the lubricating device 52, the oil dropping space 62 and the timing chain 16 can be sectioned by the expanded portions 63. According to such arrangement, the lubricating device 52 prevents the oil discharged from the oil discharge port 60 and dropping in the oil dropping space 62 from coming into contact with the timing chain 16 and scattering, thereby preventing air bubbles from being mixed into the oil.

Furthermore, in the lubricating device 52, an engine side boss portion 64 is formed at a portion close to the oil discharge port 60 in the one end wall 11 of the cylinder block 2 and above the expanded portion 63 of the chain case 20, and a case side boss portion 65 is also formed at a portion close to and facing the engine side boss portion 64 inside the chain case 20 and above the expanded portion 63.

According to the lubricating device 52 of the structure mentioned above, the oil dropping space 62 and the timing chain 16 can be sectioned by the expanded portion 63, and the oil dropping space 62 above the expanded portion 63 and the timing chain 16 can be also sectioned by the engine side boss portion 64 and the case side boss portion 65 close to and facing each other.

Thus, the lubricating device 52 can surely prevent the oil discharged from the oil discharge port 60 and dropping in the oil dropping space 62 from coming into contact with the timing chain 16 and scattering, thereby preventing air bubbles from being mixed into the oil.

Furthermore, in the lubricating device 52, since the introduction side passage portion 57 of the case side oil drain passage 56 is formed as the machined hole, and the discharge side passage portion 58 is formed as the cast hole, number of portions to be machined can be reduced, hence decreasing working cost.

In the embodiment described above, although the expanded portion 63 partitions between the oil dropping space 62 and the timing chain 16 are sectioned by the expanded portion 63, it may be possible to make narrow a gap between the expanded portion 63 and the one end wall 11 of the cylinder block 2 facing the expanded portion 63 as a modified embodiment.

Figure 6:
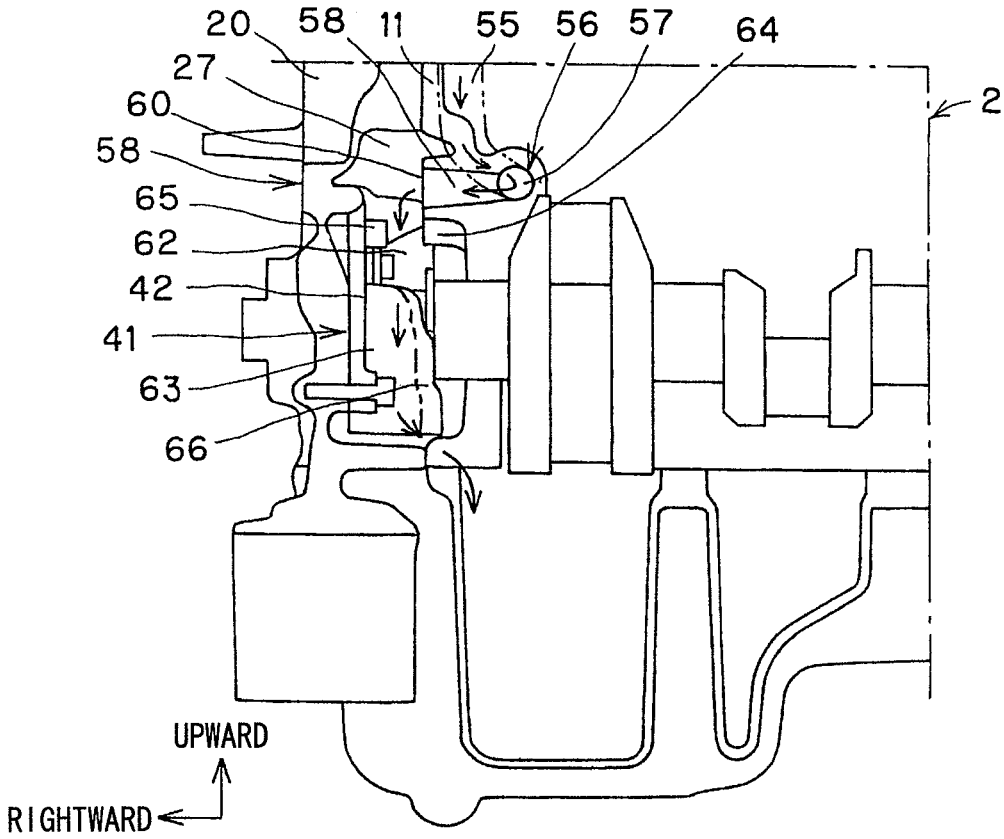
FIG. 6 is a sectional view, in an enlarged scale, taken along the line V-V according to a modified embodiment of the present invention.

That is, for example, as shown in FIG. 6, in the lubricating device 52 of this modification, a protruding portion 66 protruding toward the one end wall 11 of the cylinder block 2 is formed in the expanded portion 63 so as to shut off the gap between the expanded portion 63 and the one end wall 11 of the cylinder block 2 facing the expanded portion 63.

In this lubricating device 52, the protruding portion 66 formed in the expanded portion 63 can fill the gap between the expanded portion 63 and the one end wall 11 of the cylinder block 2.

Thus, the lubricating device 52 more surely and reliably prevents the oil discharged from the oil discharge port 60 and dropping in the oil dropping space 62 from coming into contact with the timing chain 16 and scattering.

Further, it may be possible to form the protruding portion 66 not only in the expanded portion 63, but also formed on the one end wall 11 of the cylinder block 2 facing the expanded portion 63 so as to protrude toward the expanded portion 63.

As mentioned hereinabove, according to the present invention, mixture of air bubbles into the oil that lubricates the turbocharger and is returned to the oil pan can be effectively prevented, and moreover, the mixture of air bubbles into oil that lubricates devices other than the turbocharger and is returned to an oil pan will be also applicable, thus being advantageous.

It is further to be noted that the present invention is not limited to the described embodiments and many other changes and modifications may be made without departing from the scopes of the appended claims.

What is claimed is:

1. A lubricating device for an engine provided with a cylinder block and a turbocharger, the engine being provided with a timing chain, a chain case mounted to one end in an axial direction of a crankshaft disposed in the engine so as to cover the timing chain to define a chain chamber, a turbocharger disposed on one side in a width direction of the engine on the chain case side and driven by an exhaust gas and including a bearing portion, and a lubricating device for lubricating oil within the engine, the lubricating device comprising:

an oil pan disposed below the engine; and an oil drain passage through which the oil lubricating the bearing portion returns to the oil pan, wherein the oil drain passage constitutes a pipe side oil drain passage having one end connecting to a low portion of the bearing portion and another end connecting to the crankcase at a low portion of the cylinder block, and a case side oil drain passage communicating with the pipe side oil drain passage so as to extend toward one end of an axial direction of the crankshaft along an inside of the crankcase, and the case side oil drain passage has an oil drain port which is opened to the chain chamber defined by the one end portion of the axial direction of the crankshaft in the engine and the chain case, so that the oil lubricating the bearing portion of the turbocharger is discharged in the chain chamber through the pipe side oil drain passage and the case side oil drain passage and returns to the oil pan so as not to contact a web of the crankshaft rotating in the crank chamber, and the oil is prevented from being involved with an air bubble by falling down from the chain chamber into the oil pan, wherein the oil discharge port is formed to be opened to a portion between a chain guide disposed on a tension side of the timing chain and a joint surface to the chain case of the engine, wherein in response to oil contacting the chain guide, the oil is delivered toward the oil pan, and wherein an oil pump is further provided in the chain chamber and driven by the crankshaft, wherein an oil dropping space is formed below the oil discharge port so as to communicate with the oil pan, and the oil pump has an expanded portion incorporated with a pressure regulating valve, the expanded portion being provided at a portion below the chain guide and between the oil dropping space and the timing chain extending downward from the chain guide.

2. The lubricating device of claim 1, wherein a protruding portion is formed to at least one of the expanded portion and one end wall at one end in the axial direction of the crankshaft of the engine so as to protrude toward another one thereof to thereby block a gap between the expanded portion and the one end wall of the engine facing the expanded portion.

3. The lubricating device of claim 1, wherein the oil drain passage is composed of a pipe side oil drain passage and a case side oil drain passage with which the pipe side oil drain passage communicates.

4. The lubricating device of claim 3, wherein the case side oil drain passage includes an introduction side passage section and an exhaust side passage section, in which the introduction side passage section is opened to an oil introduction port formed outside the crankcase as a machined hole extending inside the crankcase, and the exhaust side passage portion extends from an end of the introduction side passage section toward the one end portion in the axial direction of the crankshaft as a cast hole opened to an oil discharge port facing the chain chamber.

* * * * *